United States Patent [19]

Robertson et al.

[11] Patent Number: 5,058,865

[45] Date of Patent: Oct. 22, 1991

[54] LIQUID METAL PROCESSING

[75] Inventors: Thomas Robertson, Eaglescliffe; David P. Jackaman, Yarm; Richard J. Hawkins, Great Ayton, all of England

[73] Assignee: British Steel plc, London, England

[21] Appl. No.: 556,465

[22] Filed: Jul. 24, 1990

[30] Foreign Application Priority Data

Jul. 26, 1989 [GB] United Kingdom ..... 8917052

[51] Int. Cl.[5] ..... C21C 7/10

[52] U.S. Cl. ..... 266/209; 266/239

[58] Field of Search ..... 266/200, 209, 239, 236; 222/590, 591

[56] References Cited

U.S. PATENT DOCUMENTS 3,050,794 8/1962 Holz ..... 266/239
3,610,600 10/1971 Schake ..... 266/209
4,444,377 4/1984 Grotke et al. ..... 266/239
4,541,865 9/1985 Sherwood ..... 266/209

FOREIGN PATENT DOCUMENTS 1023413 3/1966 United Kingdom ..... 266/209

*Primary Examiner*—S. Kastler
*Attorney, Agent, or Firm*—Bacon & Thomas

[57] ABSTRACT

A vessel is provided having a first chamber 1 open to atmospheric pressure for receiving liquid metal and a second chamber 2 from which the metal is dispensed interconnected with the first chamber. The second chamber is sealed and coupled to means 4, 6 for reducing the pressure therein to sub-atmospheric whereby to create a higher level of metal in said second than said first chamber.

The first and second chambers may be interconnected via a refractory filter.

9 Claims, 2 Drawing Sheets

LIQUID METAL PROCESSING

Figure 1:
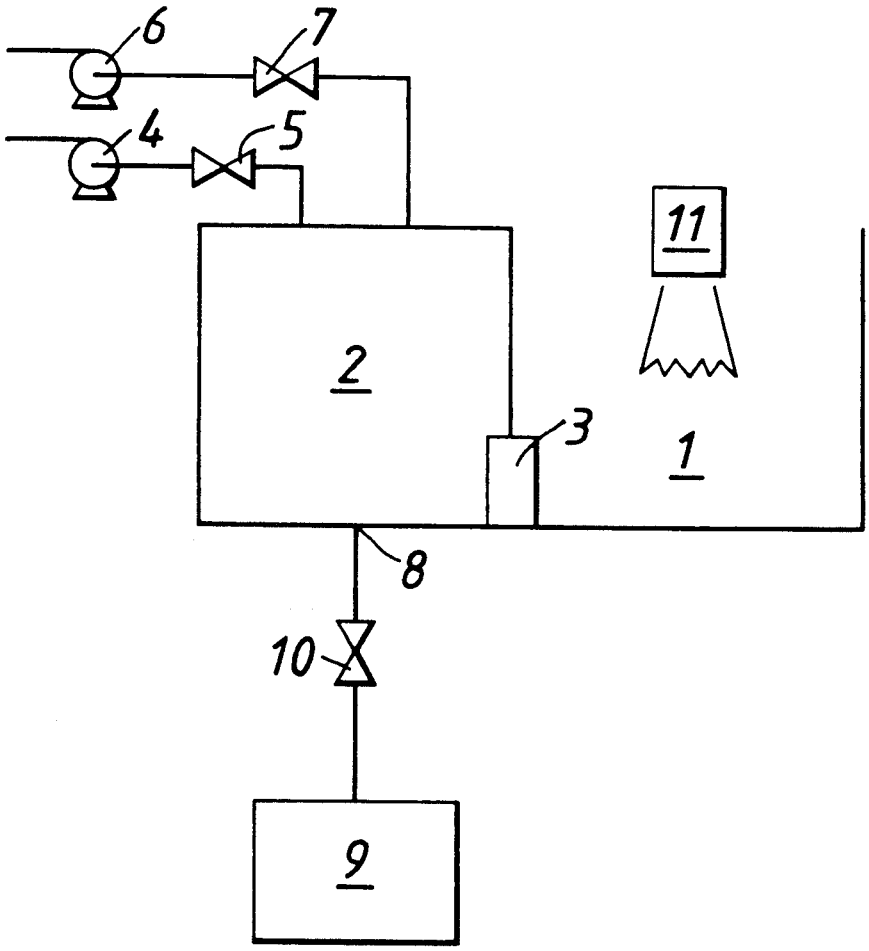

This invention relates to a method of, and apparatus for, processing liquid metal, e.g. steel.

For many metallurgical processes it is necessary or advantageous to deliver liquid metal from one vessel into a succeeding vessel in the processing route, e.g. a metal forming medium, in a controlled, low turbulence, low velocity mode. Additionally, it is advantageous for the liquid metal to be maintained in a "clean" condition for delivery to such a forming medium. Such a forming medium might for example be a casting mould, continuous casting mould, ingot mould or any container one of whose functions is the extraction of heat from the liquid metal to produce solidification. The advantages—operational, metallurgical and economic—of casting or forming from a stock of clean liquid metal delivered under controllable physical conditions are indeed well known.

Numerous systems are known by which liquid metal is dispensed into a feed container and thence via a transport medium into such a metal forming medium. The feed container, which may be any container capable of supporting a quantity of liquid metal sufficient to form a reservoir of the feed metal, will not normally ensure a controlled rate of flow, and the flow of liquid metal associated with high degrees of turbulence and high velocities into a metal forming medium is detrimental to the operation of the metal forming medium; further it is often advantageous to be able to control the rate of formation of, and the position of, the solidifying product such that attenuation of rates of growth or remelting of the product is discouraged. Moreover, it is usually the case that the liquid metal contained within the metal forming medium will be covered by a liquid non-metallic covering, which may for example be a mould lubricant, and the possibility of entrainment of such non-metallic substances into the liquid metal body away from the liquid metal surface, which is enhanced by high velocities and high turbulence, is detrimental to the product quality.

Additionally, it is most desirable to prevent the flow of non-metallic contaminants into the metal forming medium or their deposition on the walls of the transport medium which, e.g., may be a hollow tube fitted with a flow control device (for example a stopper and nozzle arrangement) attached to a submerged entry shroud, and it is a characteristic of non-metallic contaminants that they are deposited in regions where conditions of high metallostatic head, high turbulence and high velocity, apply. The areas where these contaminants are greatly detrimental to process, metallurgical and economic operation lie in the quality of the solidified product and in the premature withdrawal from service of otherwise servicable items of equipment due to non-metallic contaminant deposition.

It is the object of this invention to mitigate these problems.

According to one aspect of this invention there is provided a vessel having a first chamber open to atmospheric pressure for receiving liquid metal and a second chamber from which the metal is dispensed interconnected with the first chamber the second chamber being sealed and coupled to means for reducing the pressure therein to sub-atmospheric whereby to create a higher level of metal in said second than said first chamber.

The invention effects a reduction in the metallostatic head within the second chamber such that the metal velocity at the outlet from same is greatly reduced.

To achieve the principal object of this invention any pressure reducing medium e.g. a barrier having one or more orifices may be employed but, preferably, the first and second chambers are interconnected via a filter.

The difference in the pressures imposed on the liquid metal within the two chambers is preferably maintained at as high a level as is practicable since, in general, the 'cleaning' efficiency of the filter(s) increases with the energy dissipated by the liquid metal as it passes through. This invention thus allows the use of higher efficiency filters than has been possible hitherto.

The filter may be constructed from a refractory material having an affinity for the particular contaminants held in suspension within the liquid metal. It may be of monolithic or composite construction and the pores (which may for example be composed of slots, cylindrical holes or any open cell form) must be sufficiently small to allow the pressure gradients to be maintained at the desired flow rates and yet sufficiently large to withstand a degree of contaminant deposition without blocking the material.

Because the metal velocity at the outlet from the second vessel is reduced, flow control devices sited at the outlet can operate with greatly increased flow exit areas, lowering the rates of contaminant deposition on the surfaces of these devices which otherwise restrict the metal flow rate and promote premature failure. In particular the outlet from the second chamber may be constituted by e.g. a slide gate valve or the like and this may surmount a hollow shroud through which the metal is transported into, say, a continuous casting mould or an ingot mould or the like.

As mentioned, with the consequent 'delivery' velocity of the metal into the forming medium, and its turbulence, reduced the tendency hitherto for e.g. non-metallic mould coverings to become entrained within this metal flow into the mould, adversely affecting the product quality in thus mitigated.

Figure 2:
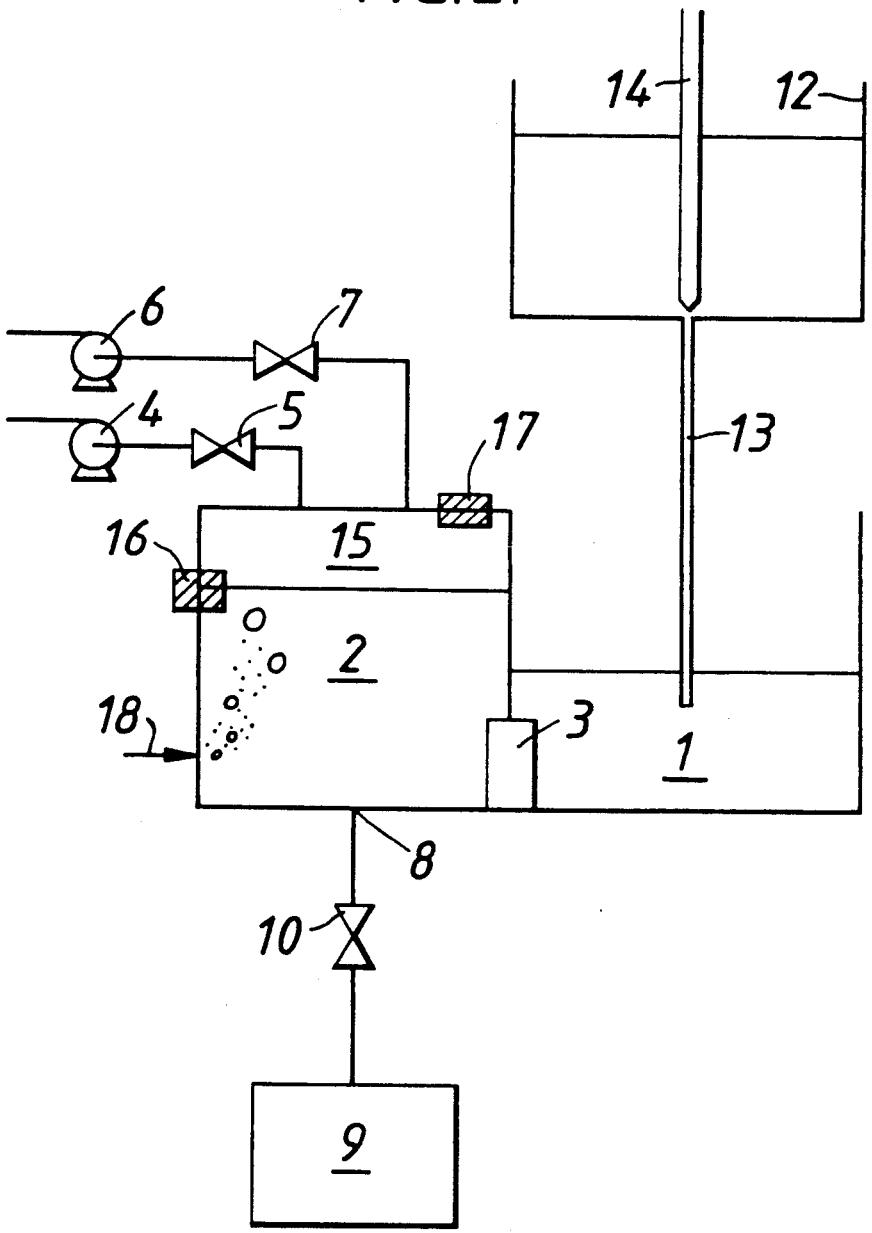

Other advantages and benefits arising from this invention will be more apparent from the following descriptions where, in order that the invention may be fully understood, one embodiment thereof will now be described, by way of example, with reference to the accompanying drawings, in which:

FIGS. 1 and 2 schematically illustrate two forms of apparatus for performing the method of this invention.

In the following description, the term "valve" relates to any form of flow control device. Referring now to the drawings, FIG. 1 shows the operation of the apparatus during the preheat phase. The apparatus consists of a first chamber connected to the open atmosphere and a second chamber 2 interconnected thereto via an apertured wall. The chamber 2 is enclosed and connected to two pressure reduction devices 4 and 6. Pressure reduction device 4 is a low differential pressure, high volume pump or ejector connected to chamber 2 via a valve 5 and pressure reduction device 6, a high differential low volume pump or ejector, is connected to chamber 2 via a valve 7. An outlet 8 is connected to a metal forming medium 9 via a valve 10.

A burner 11 introduces hot gases into chamber 1, the temperature of the gases preferably exceeding the liquidus temperature of the liquid metal to be processed.

The purpose of this preheat phase is to raise the temperature of the wall 3 to a level whereby liquid metal can be introduced into chamber 1 and flow into 2 without the liquid metal solidifying at this juncture. To achieve this purpose, valve 5 is open, valves 7 and 10 are closed and pump 4 is used to withdraw gases from within the chamber 2. The pressure within 2 will fall and the resulting pressure difference between the chambers 1 and 2 will cause hot gases produced by 11 to flow from 1 to 2 through the apertured wall. In this manner heat will be transferred from the hot gases to this wall thereby raising its temperature.

FIG. 2 shows the apparatus as used during the production phase.

In particular liquid metal flows under the influence of gravity from a container 12, e.g. a ladle, through a pour tube 13 into chamber 1. A flow control device 14, which may for example be a stopper and nozzle arrangement, is used to control the level of liquid metal in chamber 1. Valve 5 is closed and valves 7 and 10 are open. The pressure within the gas space 15 above the liquid level chamber 2 is thus reduced by the pump 6 and liquid metal flows from chamber 1 into 2 through the apertured wall under the influence of the substantial difference in pressure across this item. A liquid level monitor 16 is used to monitor the liquid level in chamber 2 and a pressure measuring device 17 is used to monitor the pressure within the gas space above the liquid metal in chamber 2 and may be used to adjust the operation of the pump 6 or the position of valve 7 so as to control the monitored pressure level. Liquid metal flows from chamber 2 through the open valve 10 into the forming medium 9. The metallostatic pressure at the outlet 8 and valve 10 resulting from the column of liquid metal above them is maintained at substantially lower levels than would have been the case if chamber 2 had not been enclosed. The effect of the sub-atmospheric pressure maintained in 15 partially opposes the metallostatic force at the inlet to valve 10 and thereby reduces the pressure difference across this valve. The resulting lower pressure difference across this valve compared with the case where the gas space 15 is not maintained at sub-atmospheric pressure, allows the design of valve 10 to be such as to present a larger area for flow of liquid metal at similar flow rates. In turn, the use of the larger areas for flow results in substantially increased distances between the flow control surfaces of valve 10 and also produces lower liquid metal velocities. Now since non-metallic contaminant deposition tends to increase with velocity, both the lower velocities and the larger inter-facial distances associated with the flow control surfaces substantially decrease the possibility of contaminant deposition and subsequent premature blockage in the regions of outlet 8 and valve 10. In turn, the low exit velocities of liquid metal from valve 10 will result in low delivery velocities into the forming medium 9. During the production phase there will be occasions when the level of liquid metal within the ladle 12 falls to where production must be suspended and another ladle employed to replace 12. During this interval, there will be no flow of liquid metal into chamber 1. Normally, the liquid metal in chamber 1 will be covered by a layer of non-metallic material. Hitherto, where liquid metal flows from a ladle such as 12 into an open container, for example a tundish, and thence into a metal forming medium, it has been found that non-metallic contaminants from this layer may be entrained within the liquid metal and be fed into the metal forming medium, thus contaminating the product. With the present invention however such contamination is eliminated by a combination of lower exit flow rates of liquid metal through the valve 10, by adjusting its setting, and maintaining a level of liquid metal in chamber 2 by using chamber 1 as a stock feed reservoir. Where the duration of such an interval between ladle changes is long, the chamber 2 can also serve as a stock feed reservoir once the stock of liquid metal in chamber 1 has become exhausted. This is made possible because the pressure in 15 is controllable thus allowing the metal level in 2 to be raised and lowered independently of the metal level in chamber 1.

During the production process, it may be desirable to introduce substances, e.g. chemical reactants, which enhance the properties of the formed product. It is advantageous to add some substances at as late a stage in the production process as possible since this eliminates the possibilities of some problems, for example segregation of alloying elements. Additionally they may be employed to reduce the level of superheat which might otherwise be required. Argon (injected at 18) may be used as a carrier gas for the introduction of these substances, the gas rising to the surface of the liquid and being exhausted from 15 by the pump 6.

Preferably, the apertured wall 3 is constituted by a cleaning or filtering device. In particular, the operation of the filter is such that non metallic contaminants suspended in the liquid metal are caused to be deposited on the surface of the material from which it is constructed, e.g. a refractory or ceramic. The high pressure drop across this filter and small pore size causes the metal to accelerate as it passes through and the highly turbulent nature associated with this region of the flow produces a very highly efficient cleaning process.

Non-metallic contaminants will of course be deposited on the surface of the filter and as this process continues the pressure difference across this item (3) required to maintain a constant flow of liquid metal from chamber 1 to chamber 2 will increase otherwise the flow of liquid metal will decrease. Liquid metal flow rates can be maintained by increasing the level of liquid metal in chamber 1 by adjusting the flow rate of metal from the ladle 12 such that the metallostatic pressure at the base of chamber 1 increases to compensate for higher required pressure gradients across the filter and indications that such action is required will be obtained by identifying a reduction in the level of product in the forming medium 9.

Although the invention has been described with reference to the particular embodiments illustrated, it is to be understood that various modifications may readily be made without departing from the scope of this invention. For example, the particular configuration of the apparatus described in the drawings and the dispositon of the control and/or monitoring equipment may well be different from that shown.

We claim:

1. A vessel having a first chamber open to atmospheric pressure for receiving liquid metal and a second chamber having an exit from which the metal is dispensed interconnected with the first chamber, the second chamber being sealed and coupled to pump means for reducing the pressure therein to subatmospheric whereby to create a higher level of metal in said second than said first chamber, wherein the first and second chambers are interconnected by a wall including one or more apertures each being disposed at substantially constant gravitational height so that liquid metal can pass from said first chamber to said second chamber and through said exit from the second chamber under the force of gravity.

2. A vessel according to claim 1, wherein the first and second chambers are interconnected via a well in which a filter is sited.

3. A vessel according to claim 2, wherein the filter is constructed from a porous refractory material.

4. A vessel according to claim 1, wherein the pressure reducing means comprises a low differential pressure, high volume pump and a high differential pressure, low volume pump, each selectively operable and connected to the said second chamber via separate valves.

5. A vessel according to claim 4, wherein reactants or alloying additions are introduced into the liquid metal in the second chamber.

6. A vessel according to claim 4, wherein the liquid metal is dispensed from the second chamber via a slide gate valve.

7. A vessel having a first chamber open to atmospheric pressure for receiving liquid metal and a second chamber having an exit from which the metal is dispensed interconnected with the first chamber via a wall in which a filter is sited, said filter being disposed at substantially gravitational heights so that liquid metal can pass from said first chamber to said second chamber and through said exit from the second chamber under the force of gravity, and wherein the second chamber is sealed and coupled to pressure reducing means comprising both a low differential pressure, high volume pump and a high differential pressure, low volume pump, each pump being selectively operable and connected to the said second chamber via separate valves for reducing the pressure in the second chamber to sub-atmospheric, in order to create a higher level of metal in said second then said first chamber.

8. A method of processing liquid metal in a vessel having a first chamber open to atmospheric pressure and a sealed second chamber having an exit interconnected with the first chamber via a filter positioned within a wall disposed at substantially constant gravitational height so that liquid metal can pass from said first chamber to said second chamber and through the exit from said second chamber under the force of gravity, comprising pre-heating the first chamber before the introduction of liquid metal therein, introducing liquid metal into said first chamber, reducing the pressure within the second chamber whilst the discharge of said metal therefrom is arrested to enable a head of the metal to be built up in said second chamber, and controlling the pressure is in said second chamber during subsequent discharge to maintain a desire metallostatic pressure at the point of discharge.

9. A method according to claim 8, further comprising introducing reactants or alloying additions into the liquid metal in the second chamber.

* * * * *